United States Patent [19]

Nelson et al.

[11] 4,077,178

[45] Mar. 7, 1978

[54] EASILY PERFORATABLE CONTAINER TO FACILITATE DISPENSING OF CONTENTS

[75] Inventors: Evan S. Nelson, Iron Mountain; Charles J. Nelson, Kingsford, both of Mich.

[73] Assignee: The Nelson Company, Iron Mountain, Mich.

[21] Appl. No.: 704,925

[22] Filed: Jul. 13, 1976

Related U.S. Application Data

[62] Division of Ser. No. 569,368, April 18, 1975, abandoned.

[51] Int. Cl.[2] ..... B65B 7/28; B65B 61/18

[52] U.S. Cl. ..... 53/15; 53/41; 53/42

[58] Field of Search ..... 53/14, 15, 27, 41, 42, 53/296, 297, 298, 372, 129, 139.3; 222/83, 541

[56] References Cited

U.S. PATENT DOCUMENTS

| | | | |
|---|---|---|---|
| 1,235,230 | 7/1917 | Myers | 222/81 UX |
| 2,114,583 | 4/1938 | Adams | 222/83 |
| 2,503,944 | 4/1950 | Frascari | 53/15 X |
| 2,734,649 | 2/1956 | Callahan et al. | 53/15 X |
| 3,118,573 | 1/1964 | Johnson | 222/541 X |
| 3,301,423 | 1/1967 | Soto | 53/15 X |
| 3,358,902 | 12/1967 | Emmert et al. | 53/15 X |
| 3,479,789 | 11/1969 | Harrison | 53/372 X |
| 3,578,519 | 5/1971 | Baumann | 53/42 X |
| 3,632,717 | 1/1972 | Showalter et al. | 53/42 X |
| 3,955,006 | 5/1976 | Sokolsky et al. | 53/14 X |

FOREIGN PATENT DOCUMENTS

| | | | |
|---|---|---|---|
| 6,403,392 | 3/1964 | Netherlands | 222/81 |

*Primary Examiner*—Othell M. Simpson
*Assistant Examiner*—Horace M. Culver
*Attorney, Agent, or Firm*—Parmelee, Johnson, Bollinger & Bramblett

[57] ABSTRACT

A container such as a metal top can containing a liquid to be dispensed by perforating the can top has an annular metal top having a concentric opening sealed with an easily perforatable thin film material. The thin film material extends across adjacent to the undersurface of the annular metal top and is sandwiched between the container top and the can body at the rim in a usual rim bead crimping operation, which leaves a projecting edge portion of the thin film outside of the rim. This edge of the film is then melted away by a hot sleeve or by spinning the sealed can relative to a hot element. The thin film material, which may be a polyester plastic, is selected to be sufficiently strong to protect the container contents during normal handling yet is more readily perforatable than the container top itself would be. The container finds extremely advantageous utility with apparatus in which the top perforator is also a conduit for dispensing the container contents and for which the container serves as a reservoir during the dispensing operation, for example in holding and dispensing paint in pint and quart size cans. The preferred range of size for the film-covered opening in the can top is from 20% to 65% of the diameter of the top.

7 Claims, 5 Drawing Figures

EASILY PERFORATABLE CONTAINER TO FACILITATE DISPENSING OF CONTENTS

This is a division, of application Ser. No. 569,368 Filed Apr. 18, 1975, and now abandoned.

BACKGROUND OF THE INVENTION

This invention relates to containers and more particularly to a rimmed top container, such as a can for holding liquid, such as paint, of the type used for coupling to a dispenser to serve as a reservoir therefor.

In U.S. Pat. No. 3,705,666, for Apparatus For Perforating and Opening a Can of Liquid and For Sealing the Opened Can Against Leakage While Coupling a Dispenser to the Opened Can," there is disclosed a dispensing apparatus that dispenses liquid effectively directly from a can with a minimum of elaborate equipment. The can of liquid itself serves as a reservoir and when used with the dispensing apparatus provides a completely portable dispensing apparatus capable of rapidly reloading. The dispensing apparatus disclosed in the aforementioned patent includes a perforator to perforate the top of the can from which it is desired to dispense liquid, such as a paint, marking liquid or a lubricating liquid. The perforator pushes a portion of the perforated top aside to provide an opening into the can; the perforator then serving as a conduit communicating with the interior of the can.

The perforating portion of the dispenser resembles a truncated cylinder in shape. The truncated or tapered shape of the perforating portion causes greater pressure to be initially applied to the top of the can at the apex of the perforating portion for puncturing the top of the can causing a cut-away can top portion to be swung down and deflected away from the cylindrical perforator-conduit in the direction of the taper.

The containers generally used with dispensing apparatus such as is disclosed in the aforementioned patent are of the flat-top, cylindrical can type having metal tops and rimmed edges. The can top or lid is secured to the cylindrical body of the can at the edge by various known enclosure types, usually a rolled or crimped rim bead seam of the single or double type.

SUMMARY OF THE INVENTION

The present invention provides a container useful with dispensing apparatus and particularly advantageously utilized with the perforating dispenser apparatus of the type disclosed in U.S. Pat. No. 3,705,666. The container of this invention facilitates perforating by the apparatus disclosed in that patent and, accordingly, even more rapid reloading of the dispensing apparatus thus becomes possible. The foregoing is accomplished, according to this invention, by providing an easily perforatable, sealed opening in the center of the metal top of the can. Thus leaving an annular metal shelf encircling the opening. The opening is concentric with the can rim dimensioned so as to receive the perforator-conduit means in sliding relationship therein. The opening is sealed, until perforated, by an easily punctured or perforated thin film of material extending across the top of the can immediately adjacent to the undersurface of the annular metal top. Thus, perforation and opening of the can becomes more convenient and the risk of tipping of the can or spillage of its contents is further reduced. Yet, the can top remains sufficiently rigid to provide structural stability to the can as a whole. Also, the annular metal top surface provides mechanical support to prevent undue deflection of the thin film by the weight of the liquid contents when the sealed container is turned upside down.

The illustrative embodiment of the invention is readily applicable to pint and quart size cans for holding and dispensing paint. The preferred range of size for the round centrally located film-covered opening in the can top is from 20% to 65% of the diameter of the top.

Thus, it is a feature of this invention to provide a containing having a top which is rigid in portion and contains an opening for receiving a perforating means, the opening being sealed with a material more readily perforatable than the material forming the rigid portion of the container top.

Another feature of this invention is the provision of an improvement in the method of sealing filled containers by providing a thin film of material between the container body and the top, and then bead crimp sealing the body, film and top together in the usual manner.

BRIEF DESCRIPTION OF THE DRAWINGS

The foregoing advantages and features of this invention will become more apparent from the following description of the preferred embodiments thereof taken in conjunction with the accompanying drawings in which.

DETAILED DESCRIPTION OF THE PREFERRED EMBODIMENTS

Figure 1:
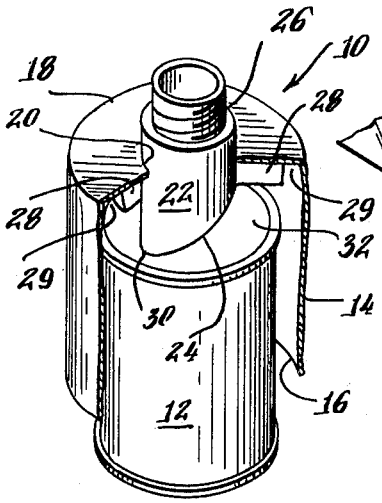
FIG. 1 is a top perspective schematic view of a perforating and opening apparatus, of the type disclosed in U.S. Pat. No. 3,705,666, shown partly in section to illustrate a typical metal top dispenser container to be opened.

Referring to FIG. 1, an apparatus 10, of the type disclosed in U.S. Pat. No. 3,705,666 for perforating and opening a can, is shown mounted in partial telescopic enclosing relationship on a can 12. The perforating apparatus 10 includes an outer cylinder 14 having a diameter larger than that of the can 12 to be enclosed. The outer cylinder 14 has an open end portion 16 which provides a guiding receptacle capable of mating over and telescoping onto the can 12. The outer cylinder 14 has a closed upper end portion 18 having a recess or opening 20 arranged therein to which is fixedly secured an annular perforator 22. The annular perforator is shaped in the form of a truncated cylinder having a perforating portion 24 and a dispenser receiving portion 26.

The cylindrical perforator 24 and the dispenser receiving portion 26 of the annular perforator 22 provide a conduit communicating with the interior of the opened can 12 capable of receiving any displaced liquid.

A sealing gasket 28 is arranged around the perforator 22 and adjacent to the inside of the closed end 18 of the outer cylinder 14 for providing a seal with the can top once it has been perforated and opened. The resilient gasket 28 is spaced away from the inner surface of the receptacle 14 so as to provide an annular clearance space at 29 for receiving the rim of the can 12. It will be understood that the foregoing is a brief description only of an aspect of the invention disclosed in U.S. Pat. No. 3,705,666, and the reader is referred thereto for a detailed description of the entire perforator and sealer apparatus.

In operation, pressure is applied to the annular perforator 22 so that the apex 30 of the perforating portion 24 contacts the can metal top or lid 32 and perforates and punctures it to cut out a flat portion which swings down into the can away from the perforator 22. It should be understood that the can 12 shown with its metal top 32 is of the type currently utilized.

Figure 2:
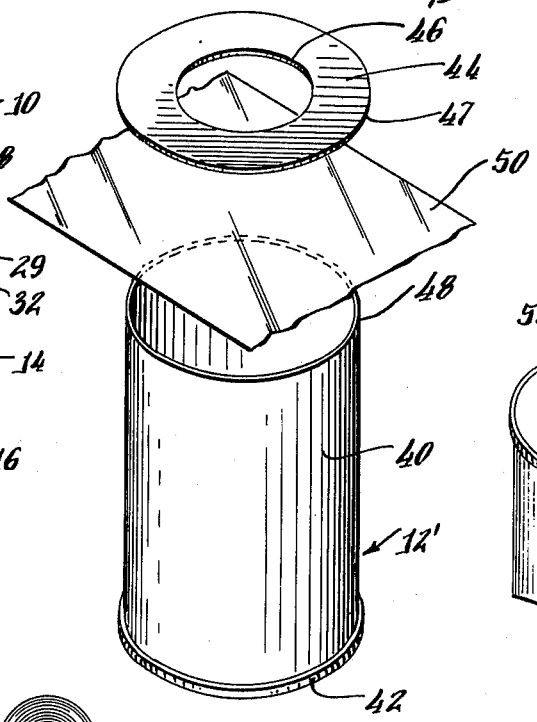
FIG. 2 is an exploded perspective view showing the container body and the container top having an opening, with the thin film positioned between the two to form a container in accordance with an embodiment of this invention.

FIG. 2 illustrates an embodiment of the invention in exploded form. Referring to FIG. 2, it is seen that the can or container 12' includes a cylindrical can body 40 to which is secured a can bottom of which the rim can be seen at 42. According to the invention, there is provided an annular top 44 having an opening 46 in the center thereof. The annular top 44 may be secured to the can body 40 by any of the known means which include end seaming as, for example, by bending the top peripheral edge 47 and can body upper edge 48 together and crimping the same to form a double seamed rim bead. The top 44 is sufficiently rigid to provide structural stability to the finished container and is usually of metal. Positioned between the top 44 and the container body 40 is a thin film of easily perforatable material, referred to generally at 50.

Figure 3:
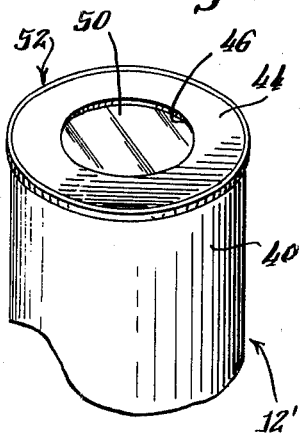
FIG. 3 is a top perspective view of a finished container according to an embodiment of this invention.
Figure 5:
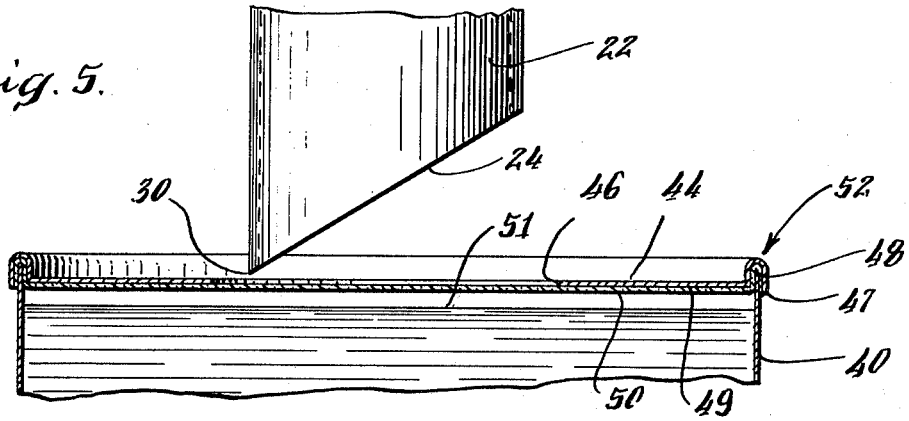
FIG. 5 is a view, partly in section, of a container according to this invention about to be perforated and illustrating also the relationship of the film and container top as sealed to the rim of the container body.

The upper half of a completely assembled container according to this invention is illustrated in FIG. 3 where it can be seen that the annular container top 44 has been joined to the container body 40 with the film 50 juxtaposed therebetween. An illustrative form of edge joining and sealing is shown more clearly in FIG. 5. Referring to FIG. 5, it can be seen that the outer edge 47 of the top 44 has been bent and crimped over the upper edge 48 of the container body 40 at the bead rim 52. The thin film material 50 extends across immediately adjacent to the entire undersurface 49 of the annular metal top 44 and is also bent over the upper edge 48 of the container body 40 to form a tight seal. The film 50 is, in effect, sandwiched between the container body 40 and the top 44 in a sandwich-like clamping fashion where it is crimped into the bead rim 48.

Also seen in FIG. 5 is the relationship of the annular perforator 22, with its perforating portion 24, to the container of this invention. The annular perforator 22 is positioned above the opening 46 which is seen to have a diameter slightly larger than the outer diameter of the perforator 22. The thin film 50 is selected to be more readily perforatable than the tops of previous cans, such as 32 in FIG. 1, and thus the perforator 22 will puncture it with greater facility and ease than heretofore has been obtained. The opening 46 may serve initially to guide or locate the perforator 22 since the film material 50 is readily perforatable while the annular top 44 is much more difficult to perforate. The opening 46 may be dimensioned so as to receive the perforator 22 in close fitting relationship.

The annular top 44 may advantageously be of metal and of a thickness comparable to previous container tops. This annular top serves as a structural support for the cylindrical container body 40 and also serves to protect the contents of the container. While in the absence of this annular top 44, the thin film material 50 would be generally inadequate as a container cover and seal, the effect of the annular top 44 and the film 50 in juxtaposition to one another provides a sufficient protective seal for the container liquid contents 51.

For providing support to the perforatable film 50 and also for providing a flat annular shelf 44 to be engaged by the gasket 28, the opening 46 in the relatively strong top 44 has a preferred diameter in the range from 20% to 65% of the diameter of the can top. For example, if the top of the can is approximately 4 inches in diameter, then the circular opening 46 may have a diameter in the range of 0.8 inches up to 2.6 inches. This defines an annular shelf or relatively rigid top 44 with a radial width on each side of the opening in the range of 1.6 inches to 0.7 of an inch. The annular top ledge or shelf 44 supports the film 50 against undue bulging when the sealed container is turned upside down so that the full weight of the liquid contents 51 rests upon the film layer 50.

The thin film 50 is selected to be more readily perforatable than the materials of construction of the previously known container tops. In addition, it must be sufficiently strong to withstand rupturing due to the movement of the contents within the container or due to inadvertent striking during storage and/or shipment or other handling. Thus, the thin film may be a thin metal foil or, advantageously, a plastic film material generally of substantially smaller thickness than the top itself. Any plastic film material having the sufficient strength and chemical resistivity to potential container contents and the ability to withstand the packaging operations such as sealing and trimming, which may involve heat, is adequate. In addition, the thin film material should be vapor proof to protect those potential container contents which may be susceptible to oxidation and/or moisture and be sufficiently impermeable to avoid the escape of moisture and vapor to the possible detriment of those contents.

While many plastic materials may be utilized, polyester film of the type available under the trademark Mylar has been found advantageously effective since it is dimensionally stable and its high strength permits the use of thinner gages than is possible with other film. If desired, this material may be obtained in a special heat sealable form and the rim may be heat sealed to provide sealing of the contents therein. Alternatively, the usual sealing compound for a rim bead seal or seam may be utilized. An advantage of this invention is that the thin film material, while being sufficiently strong to avoid rupturing under normal handling and use and to withstand the movement of contents within the container, is at the same time sufficiently flexible and thin to be utilized in a normal filling and sealing operation. Thus, the thin film 50 extends across the entire undersurface 49 of the container top 44 and is folded over the upper edge 48 of the container body 40 to permit crimping of the edge to secure and fasten the top to the container body 40 in a normal operation. Thus, filling and fabrication of containers according to this invention may proceed in the normal manner without any complex adjustment of sealing and crimping machines and tools.

Figure 4:
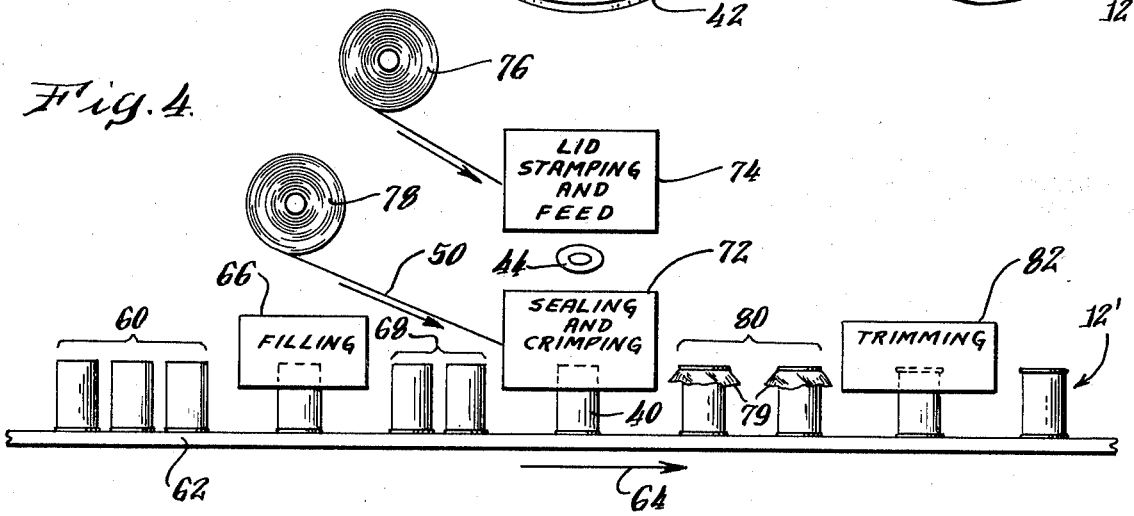
FIG. 4 is a schematic illustration of an assembly line for the production of filled containers according to an embodiment of this invention.

FIG. 4 illustrates, in schematic manner, an assembly line operation according to this invention for filling and sealing containers containing liquid, such as paint, to be utilized with a dispensing apparatus. Referring to FIG. 4, it is seen that empty containers, referred to generally at 60 move along a conveyor such as a belt 62, in the direction of the arrow 64, in a filling and fabricating operation. At a station identified by the numeral 66 filling of the empty containers occurs. The filled containers, referred to generally at 68, then proceed to a top sealing station 72. At this top sealing station 72, annular tops or lids 44 are fed from a lid fabricating station 74 which may receive metal sheet material, as from a roll illustrated schematically at 76, from which the lids may be stamped and cut to the shape desired. At the sealing and crimping station 72 the thin film material 50 is fed as a web from a roll, such as 78, of optically clear Mylar and juxtaposed between the top 44 and the filled container body 40. At the sealing and crimping station 72, suitable apparatus applies the lid 44 to the container body 40, with the film 50 positioned therebetween, and crimps the edges for a secure seal. The filled and sealed containers leave the station 72 proceeding along the belt 62 and contain excess film material 79 along their edges as shown at 80. The excess material is removed at a trimming station 82 to yield a filled sealed container 12', according to this invention, as shown in FIG. 3. The excess material 79 is trimmed off by melting away, for example by surrounding the filled and sealed can by a hot sleeve. Alternatively, the sealed can may be spun around its axis relative to a hot knife element which trims and melts away the excess material 79.

Thus, the containers according to this invention can be fabricated readily and easily utilizing existing apparatus according to current methods. The thin film material is merely positioned between the annular lid and the container body and the three are joined together with common edge seaming technology. Accordingly, there is no need to laminate or otherwise affix the thin film 50 to the annular top 44, although this may be done if desired, and complex processes and apparatus and their concomitant expense are avoided. In addition to being easily perforatable, the thin film material may be selected to be optically clear and provide the ability to view the contents of the container for an assurance that the contents therein are in proper form. This is particularly advantageous when the material to be dispensed is paint such as is to be used in a dispenser for tree marking and other uses. Since these containers holding materials to be dispensed with such apparatus are opened directly by telescoping the apparatus thereon, rather than by prying the upper lid as is customary with house paint, it is frequently too late to rectify a mistake in choice of color of paint once the can has been opened. With a container according to this invention one can see the exact color of the contents and be assured before opening it. Similar advantages may be obtained where the contents are foodstuff materials which are subjected to observable spoilage.

A container according to this invention about to be perforated for opening is shown in FIG. 5. The thin plastic material 50 may be sufficiently dimensionally stable and tightly affixed across the container body 40 so as to be rupturable by the perforator 22. If the film is too flexible, it will merely deform under pressure rather than rupturing. Moreover, the opening dimension and film material are selected so that no rupture occurs due to the movement and/or pressure of the container contents and thus a smaller diameter hole may be required when the film is not strong enough to resist these internal forces. In addition, the film material is selected to be usable with the standard crimping machine, without complex and expensive modifications due to film thickness. Following the criteria described herein those skilled in the art will be able to select the appropriate film for any particular use or for specific container contents.

I claim:

1. In a method of packaging liquid contents in a can that has a cylindrical can body terminating in can body upper edge with a rigid annular top which is adapted to be secured to said can body upper edge by crimping thereto, the improvement comprising the steps of:

forming an opening in the rigid annular top to be applied to the cylindrical can body, the size of said opening being in the range of approximately 20 to 65 percent of the diameter of said rigid annular top, feeding a thin plastic film material between the filled can body upper edge and the rigid annular top to be applied thereto, sealing the rigid annular top to the can body upper edge with the thin film positioned therebetween in a usual edge crimping operation to clamp the film between the can body upper edge and the rigid annular top, and trimming the film material to the crimped edge.

2. A method as recited in claim 1 wherein a plurality of empty containers are placed on a conveyor and are moved so as to pass through a plurality of stations in sequence, a first of said stations tautly applying said thin plastic film to the upper edge of each cylindrical can body and sealing each can by crimping the film between the upper edge of the cylindrical can and the rigid annular metal top, and a second of said stations trimming the excess film extending outwardly beyond the can body of each of the sealed cans, thereby enabling the production of such sealed cans by mass production means.

3. In a method of packaging liquid contents in a can that has a cylindrical can body terminating in a can body upper edge with a rigid annular metal top which is adapted to be secured to said can body upper edge, the improvement comprising the steps of:

forming a central opening in the rigid annular metal top, the size of said opening being in the range of 20 to 65 percent of the diameter of said annular metal top;

affixing a thin plastic film tautly across said central opening of said annular metal top; and sealing the periphery of said annular metal top to said upper edge of the can body by a usual rim bead crimping method with the thin film positioned below said annular top on the side thereof facing downwards into the cylindrical can body, whereby the liquid contents are retained in the sealed can by said thin plastic film extending across the central opening in the annular top.

4. A method as recited in claim 3, wherein a plurality of empty containers are placed on a conveyor and are moved so as to pass through a plurality of stations, a first of said stations providing the rigid annular metal top with the central opening therein and affixing said thin plastic film across the entire central opening of said annular top, a second of said stations sealing the periphery of said upper edge of the can body by a usual rim bead crimping operation with said thin plastic film positioned below said top on the side thereof facing downwards into said can body, thereby enabling the production of such sealed can bodies by mass production means.

5. In a method of packaging liquid contents in a can that has a cylindrical can body terminating in a can body upper edge with a rigid annular top which is adapted to be secured to said can body upper edge by crimping thereto, the improvement comprising the steps of:

forming a rigid annular metal top with a central opening therein for providing an annular metal top, said central opening being sized to be in the range of 20 to 65 percent of the diameter of said rigid annular top, feeding a thin plastic film tautly into position between said annular top and said can body upper edge, with the body of said can having been previously filled with the liquid contents, said thin plastic film being more easily perforatable than said annular metal top, said thin plastic film extending outwardly beyond the can body upper edge and beyond the periphery of said annular metal top, sealing the periphery of said annular metal top to said can body upper edge by a usual rim bead crimping operation with the thin plastic film being sandwiched between the crimped periphery of the annular metal top and the crimped upper edge of the can body for sealing the liquid contents with the can, said thin plastic film extending across and immediately adjacent to the entire undersurface of the annular metal top, and trimming off the portion of said thin plastic film which extends outwardly beyond the can body, whereby the liquid contents are retained in the sealed can solely by said thin plastic film extending across the central opening in said annular metal top.

6. A method as recited in claim 5 wherein the thin polyester film is transparent, thereby allowing observation of the contents through said opening in the circular top without disturbing the seal.

7. A method as recited in claim 5 wherein the thin polyester film is vapor proof, thereby preventing the danger of release of harmful vapors from the contents.

* * * * *